US009487918B2

(12) United States Patent
Geerdinck et al.

(10) Patent No.: US 9,487,918 B2
(45) Date of Patent: Nov. 8, 2016

(54) LIDDING MATERIAL FOR BLISTER PACKAGING AND THE LIKE

(71) Applicant: Coldenhove Know How B.V., Eerbeek (NL)

(72) Inventors: Hugo Geerdinck, Eerbeek (NL); Koert Johannes Sportel, Eerbeek (NL)

(73) Assignee: COLDENHOVE KNOW HOW B.V., Eerbeek (NL)

( * ) Notice: Subject to any disclaimer, the term of this patent is extended or adjusted under 35 U.S.C. 154(b) by 0 days.

(21) Appl. No.: 15/026,554

(22) PCT Filed: Sep. 30, 2014

(86) PCT No.: PCT/NL2014/050666
§ 371 (c)(1),
(2) Date: Mar. 31, 2016

(87) PCT Pub. No.: WO2015/050438
PCT Pub. Date: Apr. 9, 2015

(65) Prior Publication Data

US 2016/0244914 A1 Aug. 25, 2016

(30) Foreign Application Priority Data

Oct. 1, 2013 (NL) ..... 2011532

(51) Int. Cl.
*D21H 19/10* (2006.01)
*D21H 19/56* (2006.01)
(Continued)

(52) U.S. Cl.
CPC ..... *D21H 19/10* (2013.01); *A61J 1/035* (2013.01); *B05D 1/28* (2013.01); *B65B 7/16* (2013.01); *B65D 65/42* (2013.01); *B65D 75/36* (2013.01);
(Continued)

(58) Field of Classification Search
CPC ..... D21H 19/10; D21H 19/56; D21H 19/82; D21H 27/10; B65B 7/16; A61J 1/035; B65D 75/36; B65D 65/42; B65D 1/28
See application file for complete search history.

(56) References Cited

U.S. PATENT DOCUMENTS 4,360,550 A 11/1982 Asakura et al.
2010/0170820 A1 7/2010 Leplatois et al.

FOREIGN PATENT DOCUMENTS

WO WO-2009118761 A2 10/2009

OTHER PUBLICATIONS

"International Application Serial No, PCT/NL2014/050666, International Written Opinion mailed Mar. 3, 2015", 3 pgs.
(Continued)

*Primary Examiner* — Michael C Miggins
(74) *Attorney, Agent, or Firm* — Schwegman Lundberg & Woessner, P.A.

(57) ABSTRACT

The invention is directed to a lidding material that can be used in blister packaging and the like. In particular, the invention is directed to a lidding material for blister packaging comprising a base paper on which is present a pre-barrier layer and a latex coating, wherein the pre-barrier layer is present between the base paper and the latex coating, wherein the lidding material has a Mullen burst strength between 80 and 200 k Pa, as defined by ISO standard 2758, a tear strength between 100 and 400 m N, as defined by ISO standard 1974, and a water vapor transmission rate of ≤4 g/m 2/day (determined at a temperature of 38° C. and at a relative humidity of 100%, as defined by ASTM F1249), and wherein the lidding material optionally further comprises a sealant layer adjacent to the latex coating.

19 Claims, 2 Drawing Sheets

Figure 1:
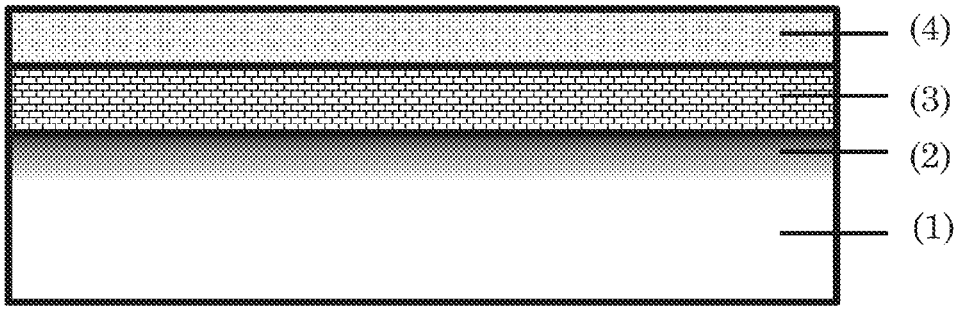

(51) Int. Cl.

| | |
|---|---|
| ***D21H 19/82*** | (2006.01) |
| ***D21H 27/10*** | (2006.01) |
| ***B65B 7/16*** | (2006.01) |
| ***A61J 1/03*** | (2006.01) |
| ***B65D 75/36*** | (2006.01) |
| ***B65D 65/42*** | (2006.01) |
| ***B05D 1/28*** | (2006.01) |

(52) U.S. Cl.
CPC ..... *D21H 19/56* (2013.01); *D21H 19/82* (2013.01); *D21H 27/10* (2013.01)

(56) References Cited

OTHER PUBLICATIONS

"International Application Serial No. PCT/NL2014/050666, International Written Opinion mailed Mar. 3, 2015", 3 pgs.

LIDDING MATERIAL FOR BLISTER PACKAGING AND THE LIKE

PRIORITY APPLICATIONS

This application is a U.S. National Stage Filing under 35 U.S.C. 371 from International Application No. PCT/NL2014/050666, filed on 30 Sep. 2014, and published as WO 2015/050438 on 9 Apr. 2015, which claims the benefit of priority to Netherlands Application No. 2011532, filed on 1 Oct. 2013; which applications and publication are incorporated herein by reference as if reproduced herein and made a part hereof in their entirety, and the benefit of priority of each of which is claimed herein.

The invention is directed to a lidding material that can be used in blister packaging and the like.

In the art, so called blister packaging is typically used to package small articles, such as single dose units of pills or other pharmaceuticals, as well as chewing gum or other sweets. This type of packaging comprises a so called lidding foil, which is adhered to a polymeric "blister", i.e. a sheet of polymeric material that is formed to have pockets that can hold the articles individually.

The contents of the blister packaging can be removed from the packaging by pressing against the polymeric blister sheet at the location of the pocket until the covering lidding foil is broken through. Typically this type of blister packaging is known as a push-through type. Two key requirements of the push-through type blister packaging are that (i) the lidding foil is sufficiently brittle that it breaks when the contents in the pockets are pressed against it and that (ii) the polymeric blister sheet is sufficiently malleable that it can be deformed, for instance, with a thumb.

Blister packaging most frequently used by manufacturers are easy to produce, meet the shelf-life requirements of its contents by providing a complete barrier to air and moisture, and prevent tampering. Further, the lidding foil used in the blister packaging must be readily printable such that specific information can be printed on the back of each individual pocket for the benefit of the consumer and the manufacturer.

One of the most commonly manufactured type of blister packaging comprises a lidding foil, typically aluminium foil, to which a heat seal lacquer is applied. Polymers typically used in the polymeric blister sheet include polyvinyl chloride (PVC), PVC coated with polyvinylidene chloride (PVDC), polyethylene terephthalate (PET), polychlorotrifluoroethylene (PCTFE), cyclic olefin copolymers (COC) and polypropylene (PP). PCTFE, PVC coated with PVDC, and PP are more preferred, due to having better moisture and air barrier properties, as well as being more inert than for example PVC only.

WO-A-2009/105858, incorporated herein in its entirety, describes a lidding foil for blister packaging. The lidding foil of WO-A-2009/105858 comprises an aluminium foil layer on which one or more layers of both a tie layer and a sealant layer are applied by extrusion coating resulting in a lidding foil with improved barrier and inert properties. The disadvantage of this lidding foil is that the use of an aluminium foil makes it both expensive and difficult to recycle. A further disadvantage is that aluminium is difficult to print on. In addition, aluminium is generally not considered to be a renewable material.

US-A-2010/0170820, incorporated herein in its entirety, describes a paper-based lidding material for blister packaging, which lidding material comprises a paper layer upon which is a barrier layer containing cyclic olefin copolymers (COC). US-A-2010/0170820 describes that the lidding material may be produced either by extrusion coating or laminating the paper layer with one or more layers of a barrier layer containing cyclic olefin copolymers.

However, the disadvantage of using the lidding material of US-A-2010/0170820 is that it is prone to delamination. Delamination of the protective barrier layer results in the lidding material not providing an effective air and moisture barrier in the blister packaging which shortens the shelf-life of the contents. A further disadvantage is that the lidding material is sensitive to handling. As such, the lidding material would be more prone to damage during shipping and handling which would compromise the barrier properties of the packaging and result in unacceptable economic losses.

IN-A-1239/MUM/2006 describes a paper based lidding material for blister packs comprising a paper layer coated with at least one barrier coat and a heat sealing coat on one side and an optical lacquer coat on the other side. Neither the Mullen burst strength nor the tear strength of these lidding materials are described in IN-A-1239/MUM/2006.

It is therefore an object of the present invention to provide an improved lidding material for blister packaging and the like.

Surprisingly it was found that not only the barrier properties of a lidding material can be improved, but also its printability may be improved, in particular if a lidding material is used comprising a base paper on which is present a latex coating. In addition, it has been found that such a lidding material has a high content of renewable material and is much more easy to recycle.

Accordingly, the invention is directed to a lidding material for blister packaging comprising a base paper on which is present a pre-barrier layer and a latex coating, wherein the pre-barrier layer is present between the base paper and the latex coating, wherein the lidding material has a Mullen burst strength between about 80 and 200 kPa, as defined by ISO standard 2758, a tear strength between about 100 and 400 mN, as defined by ISO standard 1974, and a water vapour transmission rate of ≤4 $g/m^2/day$ (determined at a temperature of 38° C. and at a relative humidity of 100%, as defined by ASTM F1249), and wherein the lidding material optionally further comprises a sealant layer adjacent to the latex coating.

The pre-barrier layer and the latex coating, and optionally the sealant layer of the lidding material according to the invention act together to seal the base paper such that the water vapour permeability and porosity of the base paper is significantly reduced thus providing the lidding material with good barrier properties.

The lidding material of the invention typically comprises one or more layers of the latex coating. The term "latex", as defined herein, is a stable dispersion (emulsion) of polymer microparticles in an aqueous medium. The latex coating may suitably comprises a water-dispersible polymer selected from the group consisting of styrene-butadiene rubber, acrylonitrile butadiene styrene, acrylic polymers, polyvinyl acetate, PVDC, PCTFE, COC and combinations thereof. Preferably, the latex coating comprises PVDC and/or PCTFE.

The latex coating typically used has a weight of from 5 to 50 $g/m^2$, preferably of from 10 to 40 $g/m^2$, and most preferably of from 15 to 30 $g/m^2$.

The lidding material of the invention typically comprises one or more layers of the pre-barrier layer coating. The pre-barrier layer which may be used comprises an acrylic based binder and optionally one or more pigments. The advantage of the lidding material having a pre-barrier layer is that the pre-barrier layer not only strengthens the base paper but also provides a closed surface structure. Typically the base paper coated with the pre-barrier layer has a Bendtsen porosity of 0 ml/min, as defined by ISO standard 5636-3.

The acrylic based binders which may be used in the pre-barrier layer include polyacrylates comprising alkyl acrylates, and/or polyalkyl methacrylates, wherein the alkyl group has 1 to 10 carbon atoms, preferably 1 to 4 carbon atoms and combinations thereof. Suitable polyacrylates may further comprise styrene and/or vinyl acetate. The polyacrylates may be chosen from one or more homopolymers, copolymers (e.g. block copolymers, random copolymers and graft copolymers), mixtures, composites, cross-linking and blends of the above-mentioned polyacrylates. Preferably the acrylic based binder used in the pre-barrier layer has a viscosity of between about 100 and 400 mPa·s, as measured by a Brookfield viscometer using a spindle no. 2 at 100 rpm and at a temperature of 45° C.

The pre-barrier layer may further comprise co-binders such as starch, casein, protein, polyacrylate, polyvinyl alcohol and combinations thereof.

The one or more pigments which may be present in the pre-barrier layer include inorganic pigments, preferably plate-like (i.e. lamellar) inorganic pigments for example, mica, aluminum silicates (e.g. kaolin (also known as china clay)), magnesium silicates (e.g. talc), iron oxides and the like.

The pre-barrier layer may further comprise one or more additives, such as water retentions aids, rheology modifiers, sizing agents and the like.

The lidding material according to the invention may further comprise one or more layers of the optional sealant layer. The sealant layer may comprise polymers such as polyethylene, polypropylene (PP), polyhydroxyalkanoates (PHAs), amorphous polylactide (PLA), waxes, starches, polyglycolic acid (PGA), biodegradable polyesters, ethylene-propylene (EP) copolymer, propylene-butylene (PB) copolymer, ethylene-butylene (EB) copolymer, ethylene-propylene-butylene (EPB) terpolymer, ethylene vinyl acetate (EVA) copolymer, butyl methacrylate polymer, vinyl chloride-vinyl acetate-ethylene terpolymer and combinations thereof. Preferably, the sealant layer comprises a vinyl chloride-vinyl acetate-ethylene terpolymer.

Typically the optional sealant layer of the lidding paper of the invention has a weight of 5-20 g/m$^2$, and preferably 5-15 g/m$^2$.

Base papers suitable to be used in the lidding material according to the invention typically comprise cellulose and one or more additives. Suitable additives which may be present in the base paper include filler pigments, wet strength agents, cross-linking agents, retention aids, fixing aids, colour pigments, dyes and combinations thereof. The types of cellulose which may be used in the base paper include softwood cellulose, hardwood cellulose and mixtures thereof.

Typically the base paper used has a weight of from 30 to 100 g/m$^2$, preferably of from 30 to 80 g/m$^2$, and most preferably of from 35 to 60 g/m$^2$.

The Mullen burst strength and the tear resistance of the base paper act cooperatively within an operating window. More specifically, base paper with a higher burst value typically require a lower tear strength value for a good push-through experience. Conversely, base paper with a lower Mullen burst value, typically require a higher tear strength value to prevent the package from damage.

The Mullen burst strength of the lidding material according to the invention is typically between about 80 and 200 kPa, and preferably between about 100 and 180 kPa, as defined by ISO standard 2758.

The Mullen burst strength is measured by means of a Mullen tester. A test specimen, such as the lidding material, is held between annular clamps, and is subjected to an increasing pressure by a rubber diaphragm, which is expanded by hydraulic pressure at a controlled rate, until the test specimen ruptures. The pressure reading at the instant of rupture is recorded as the bursting strength.

The tear strength of the lidding material according to the invention is typically between about 100 and 400 mN, and preferably between about 200 and 300 mN, as defined by ISO standard 1974. The term "tear strength", as used herein, encompasses both the tear strength in the machine direction (MD), and the tear strength cross the machine direction (CD).

The tear strength is determined by means of an Elmendorf device, wherein a falling pendulum tears a test specimen e.g. the lidding material. The force that is needed to tear the test specimen is then calculated from the energy of the pendulum.

The water vapour transmission rate of the lidding material of the invention is typically =4 g/m$^2$/day, and preferable 1-3 g/m$^2$/day, determined at a temperature of 38° C. and at a relative humidity of 100%, as defined by ASTM F1249.

The water vapour transmission rate is an important parameter for blister packaging, in particular when used for packaging water sensitive articles, such as food and pharmaceuticals. Such blister packaging must have a sufficiently low water vapour transmission rate that the required quality, safety and shelf-life requirements of the articles are met. These requirements are advantageously met by the lidding material of the invention.

The conditions under which the measurement of the water vapor transmission rate is determined also have a considerable influence on the result. Both the temperature and the relative humidity of the sample need to be measured, controlled and recorded with the result. A water vapor transmission rate result determined without specifying these conditions is almost meaningless.

The document US-A-2010/0170820 describes measuring the water vapor transmission rate of different lidding material for blister packaging. However, US-A-2010/0170820 does not describe the temperature or the relative humidity under which these measurements are determined.

A further advantage of the lidding material according to the invention is that it can be sealed to a variety of polymeric blister sheets, and is particularly useful for blister packaging and the like.

In an additional embodiment, the invention is directed to a blister packaging comprising a lidding material according to the invention sealed to a polymeric blister sheet.

Suitable polymeric blister sheets which may be used in the blister package according to the invention comprise a polymer selected from the group consisting of non-plasticized PVC, PVC coated with PVDC, PET, PCTFE, COC, polystyrene (PS), polyethylene (PE), PP, polyethylene terephthalate glycol (PETG), amorphous polyethylene terephthalate (APET) and combinations thereof. Preferably, the polymer selected is PVC, PVC coated with PVDC, PCTFE, PETG, APET and/or PP.

In another embodiment, the invention is directed to a process for preparing a lidding material for blister packaging, wherein a pre-barrier layer is applied onto a base paper by means of a coating process, wherein a latex coating is then applied onto the pre-barrier layer on the base paper by means of a further coating process and wherein optionally a sealant layer is subsequently applied onto the latex coating by means of a further coating process.

Preferably both the pre-barrier layer and the latex coating is applied onto the smooth side of the base paper. The smooth side of the paper, as defined herein, is normally the side of a paper which does touch the wire on the paper machine during the paper making process.

Suitable means of coating the base paper with the latex coating include the reverse gravure coating process, the rod coating process, the screen coating process, the curtain coating process, and the like. Preferably the coating process used is the reverse gravure coating process. The advantage of using of the reverse gravure coating process is that it allows a relatively thin layer of the latex coating to be applied onto the base paper, because of the contour-following principle made use of in this process.

Prior to applying the latex coating to the base paper, the pre-barrier layer is applied to the smooth side of the base paper. This can be done by a coating process, such as the size press treatment.

The optional sealant layer may be applied onto the latex coating by means of any one of the coating processes mentioned above which are suitable for applying the latex coating. Preferably, the coating process used is the same as that used for applying the latex coating.

In a further embodiment, the invention is directed to a process for preparing blister packaging comprising sealing a lidding material according to the invention to a polymeric blister sheet containing one or more articles.

Suitable apparatuses for preparing blister packaging according to the invention include sealing machines and standard packaging machines.

The polymeric blister sheets typically used in the process for preparing a blister package of the invention are the same as those mentioned above.

The one or more articles contained within the blister packaging according to the invention may suitable be selected from the group consisting of pharmaceuticals in the form of pills, tablets, and capsules; and non-pharmaceuticals including chewing gum, sweets, vitamins, and dietary or nutritional supplements. The lidding material of the invention can be used in a variety of applications. Especially preferred is that the lidding material is used in the production of blister packaging for pharmaceuticals in the form of pills, tablets, capsules and the like; and also for non-pharmaceuticals, such as chewing gum, sweets, vitamins, and dietary or nutritional supplements and various other goods like disposable contact lenses or hearing aid batteries. By increasing the base paper weight and the strength properties, such as the tear strength which may be adjusted by changing the long fiber/short fiber ratio and/or changes to the refining energy in the chemical pulp used to produce the base paper, the lidding material may also be used to seal containers for food and beverages, for instance, yoghurts, puddings, custards, gelatins, fruit sauces/juices, cheese spreads, dips and dairy based beverages. In addition, the lidding material may be used in single use sachets for food condiments including mustard, tomato sauce, mayonnaise and the like; and for cosmetics samples, such as make-up, perfume, shampoo, moisturizes and sunscreen.

FIG. 1 shows schematically a lidding material according to the invention comprising a (1) a base paper, (2) a pre-barrier layer, (3) a latex coating and (4) an optional sealant layer.

Figure 2:
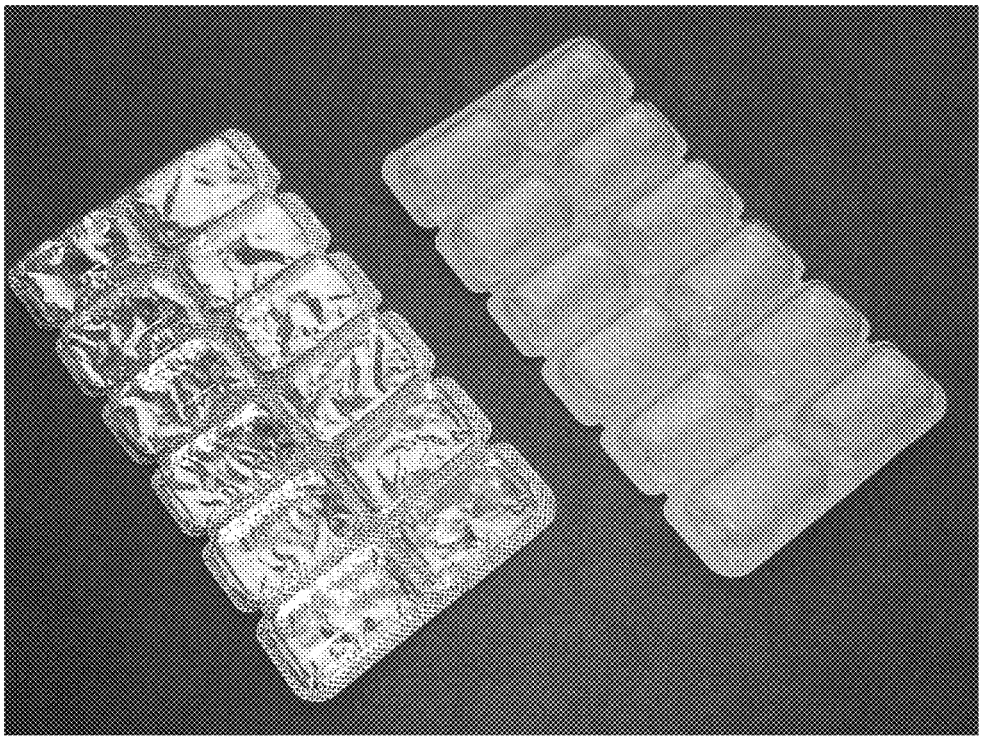

FIG. 2 shows a photograph of two types of blister packaging. The blister packaging on the left-hand side of the photograph corresponds to a known type which comprises an aluminium lidding. The one on the right-hand side of the photograph corresponds to the blister packaging according to the invention.

The present invention is now elucidated on the basis of the following non-limiting examples.

EXAMPLES

Blister lidding paper examples 1-9 were prepared using a base paper produced exclusively from chemical pulp and consisting of about 90 wt. % short fibers and about 10 wt. % of long fibers, refined to a beating degree of around 24 degrees, as measured with a Schopper Riegler tester. The base paper used also consisted of a filler based on calcium carbonate in an amount of about 5 to 10 wt. %.

Examples 1-9 were coated offline with a latex coating by reverse gravure roll coating. The latex coating was applied as a water based PVDC dispersion.

Examples 2-9 were also coated with a pre-barrier layer using a size press, prior to coating with the latex coating. The pre-barrier layer was applied as a kaolin clay-dispersion with a styrene-acrylic based binder and rheology-modifiers based on polyacrylamide. The application of the pre-barrier layer on the base paper resulted in a closed surface structure of the paper, which had a Bendtsen porosity of 0 ml/min, as defined by ISO standard 5636-3.

Examples 4, 6 and 7 were also coated offline with a sealant layer using reverse gravure roll coating. The sealant layer consisted of a vinyl chloride-vinyl acetate-ethylene terpolymer.

The blister lidding papers of examples 1-7 were then sealed against a pre-formed PVC blister sheet having a thickness of 250 μm in a blister packaging machine. Example 8 was sealed against a pre-formed PVDC coated PVC blister sheet in a blister packaging machine, wherein the thickness of the PVDC coating was 40 μm and the PVC blister sheet was 250 μm, respectively. Example 9 was sealed against a pre-formed PET-GAG (i.e. co-extruded film with three layers consisting of PETG-APET-PETG) blister sheet, also having a thickness of 250 μm. The pockets of the blister package examples were filled with chewing gum dragees.

Reference examples 1-3 correspond to LT5008 winpak, and two types of aluminium alloy AA8079 temper H 20 foil each having 1.5 $g/m^2$ print primer and 7 $g/m^2$ heat seal lacquer with a total weight of 65 $g/m^2$ and 51 $g/m^2$, respectively. Reference example 4 corresponds to the claimed values of the blister packaging of US-2010/0170820 in which the conditions under which the WVTR value were measured are not described. Reference example 5 corresponds to a blister sheet comprising PVC having a thickness of 250 μm.

The following properties of the prepared blister packaging examples were determined and are shown in Table 1.

The Mullen burst (MB) strength of the blister packaging, was measured using ISO standard 2758.

The tear strength MD and the tear strength CD, was measured according to ISO standard 1974.

The WVTR was measured at a temperature of 38° C. and at a relative humidity of 100%, as defined by ASTM F1249.

An evaluation of the seal performance was determined by pressing on the blister and look at possible air leakage and to determine if the sealed areas between the pockets were unable to peel open.

The push-through-experience was determined by pressing on the blister and comparing the experience with a conventional aluminium blister packaging. The experience description is based on the force needed to be applied to burst the pocket by a thumb, the shape of the burst at the pocket, and whether only one pocket opened, i.e. no other pockets in the blister packaging were also opened.

TABLE 1

| Example No. | 1 | 2 | 3 | 4 | 5 | 6 | 7 | 8 | 9 | Ref. 1 | Ref. 2 | Ref. 3 | Ref. 4 | Ref. 5 |
|---|---|---|---|---|---|---|---|---|---|---|---|---|---|---|
| Base paper ($g/m^2$) | 48 | 60 | 55 | 55 | 40 | 40 | 36 | 40 | 36 | 32 | — | — | | |
| Pre-barrier layer | No | Yes | Yes | Yes | Yes | Yes | Yes | Yes | Yes | — | — | — | | |
| Latex coating ($g/m^2$) | 22 | 24 | 24 | 24 | 19 | 19 | 14 | 25 | 14 | — | — | — | | |
| Sealant layer ($g/m^2$) | 0 | 0 | 0 | 10 | 0 | 11 | 7 | 0 | 0 | — | — | — | | |
| Total weight ($g/m^2$) | 60 | 84 | 79 | 89 | 59 | 70 | 57 | 65 | 50 | 59 | 65 | 51 | | |
| Tear strength MD (mN) | 285 | 370 | 375 | 390 | 240 | 250 | 220 | 240 | 215 | 210 | 145 | 100 | <490 | |
| Tear strength CD (mN) | 320 | 410 | 420 | 420 | 280 | 300 | 260 | 290 | 250 | 250 | 145 | 100 | | |
| MB strength (kPa) | 235 | 160 | 260 | 265 | 140 | 145 | 125 | 140 | 115 | 130 | 200 | 115 | <207 | |
| WVTR ($g/m^2$/day) | >100 | 2-4 | 4.3 | 2.8 | 4.6 | 2.4 | 2.7 | 3.6 | 3.2 | 7 | <0.1 | <0.1 | <4.7 | 4 |
| Blister sheet type | PVC | PVC | PVC | PVC | PVC | PVC | PVC | PVC/PVDC | PET-GAG | PVC | PVC | PVC | | |
| Seal performance | — | — | — | + | + | ++ | ++ | ++ | ++ | ++ | ++ | ++ | | |
| Push-through experience | n.a. | n.a. | — | + | ++ | ++ | ++ | ++ | ++ | ++ | ++ | ++/− | | |

Seal Performance

− Poor (the lidding material did not adhere to the blister sheet).

+ Moderate (the lidding material adheres well to the blister sheet, but only by increasing the seal time and temperature above the standard operating conditions of the sealing machine used for sealing the blister sheet to the lidding material).

++ Good (the lidding material's adherence to the blister sheet was comparable to that of the aluminium blister packaging, no adjustments were needed to the standard operating conditions of the sealing machine used).

Push-through Experience n.a. Not applicable (the lidding material did not adhere to the blister sheet, so this property could not be determined).

− Tough (too much pressure required to open pocket, dragee cracked).

+ Moderate (more pressure required to open pocket than aluminium blister packaging, dragee did not crack).

++ Good (comfortable opening force needed, dragees did not crack, lidding did not tear open pockets other than the ones directly pushed on)

++/− Very easy (too easy to open pockets, risk of spontaneous opening of pockets by rough handling of the packaging).

The invention claimed is:

1. Lidding material for blister packaging comprising a base paper on which is present a pre-barrier layer and a latex coating, wherein the pre-barrier layer is present between the base paper and the latex coating, wherein the lidding material has a Mullen burst strength between 80 and 200 kPa, a water vapor transmission rate of ≤4 $g/m^2$/day determined at a temperature of 38° C. and at a relative humidity of 100%, as defined by ASTM F1249, and a tear strength between 100 and 400 mN, as defined by ISO standard 1974, and wherein the lidding material optionally further comprises a sealant layer adjacent to the latex coating.

2. The lidding material according to claim 1, wherein the latex coating comprises a water-dispersible polymer selected from the group consisting of styrene-butadiene rubber, acrylonitrile butadiene styrene, an acrylic polymer, polyvinyl acetate, polyvinylidene chloride, polychlorotrifluoroethylene, a cyclic olefin copolymer and combinations thereof.

3. The lidding material according to claim 1, wherein the latex coating has a weight of from 5 to 50 $g/m^2$.

4. The lidding material according to claim 1, wherein the base paper has a weight of from 30 to 100 $g/m^2$.

5. The lidding material according to claim 1, wherein the Mullen burst strength is between 100 and 180 kPa, as defined by ISO standard 2758; and, wherein the tear strength is between 200 and 300 mN, as defined by ISO standard 1974.

6. The lidding material according to claim 1, wherein the water permeability of lidding material is 1-3 $g/m^2$/day, determined at a temperature of 38° C. and at a relative humidity of 100%, as defined by ASTM F1249.

7. The lidding material according to claim 1, wherein the base paper further comprises one or more additives selected from the group consisting of filler pigments, wet strength agents, cross-linking agents, retention aids, fixing aids, color pigments, dyes and combinations thereof.

8. The lidding material according to claim 1, wherein the pre-barrier layer comprises an acrylic based binder and optionally one or more pigments.

9. The lidding material according to claim 1, wherein the sealant layer comprises a polymer selected from the group consisting of polyethylene, polypropylene, polyhydroxyalkanoate, amorphous polylactide, a wax, a starch, polyglycolic acid, a biodegradable polyester, ethylene-propylene copolymer, propylene-butylene copolymer, ethylene-butylene copolymer; ethylene-propylene-butylene terpolymer, ethylene vinyl acetate copolymer, butyl methacrylate polymer, vinyl chloride-vinyl acetate-ethylene terpolymer and combinations thereof.

10. A process for preparing a lidding material according to claim 1, wherein a pre-barrier layer is applied onto a base paper by means of a coating process, wherein a latex coating is then applied onto the pre-barrier layer on the base paper by means of a further coating process, and wherein optionally a sealant layer is subsequently applied onto the latex coating by means of a further coating process.

11. The lidding material according to claim 1, wherein the latex coating has a weight of from 10 to 40 $g/m^2$.

12. The lidding material according to claim 1, wherein the latex coating has a weight of from 15 to 30 $g/m^2$.

13. The lidding material according to claim 1, wherein the base paper has a weight of from 30 to 80 $g/m^2$.

14. The lidding material according to claim 1, wherein the base paper has a weight of from 35 to 60 g/m$^2$.

15. The lidding material according to claim 1, wherein the latex coating comprises polyvinylidene chloride and/or polychlorotrifluoroethylene.

16. Blister packaging comprising a lidding material according to claim 1 sealed to a polymeric blister sheet.

17. The blister packaging according to claim 16, wherein the polymeric blister sheet comprises a polymer selected from the group consisting of non-plasticized polyvinyl chloride, polyvinyl chloride coated with polyvinylidene chloride, polyethylene terephthalate, polychlorotrifluoroethylene, a cyclic olefin copolymer, polystyrene, polyethylene, polypropylene, polyethylene terephthalate glycol, amorphous polyethylene terephthalate and combinations thereof, and preferably polychlorotrifluoroethylene, polyvinyl chloride, polyvinyl chloride coated with polyvinylidene chloride, polyethylene terephthalate glycol, amorphous polyethylene terephthalate and/or polypropylene.

18. A process for preparing blister packaging according to claim 16, wherein a lidding material is sealed to a polymeric blister sheet containing one or more articles.

19. The process according to claim 18, wherein the one or more articles are selected from the group consisting of pharmaceuticals in the form of pills, tablets, and capsules; and non-pharmaceuticals comprising chewing gum, sweets, vitamins and dietary or nutritional supplements.

* * * * *